United States Patent [19]

Schultz

[11] 3,961,180

[45] June 1, 1976

[54] LUMINAIRE DURATION CONTROL

[76] Inventor: Frank H. Schultz, 329 Knight Way, La Canada, Calif. 91011

[22] Filed: Feb. 4, 1974

[21] Appl. No.: 439,447

[52] U.S. Cl. ..... 250/206; 317/124; 315/159

[51] Int. Cl.[2] ..... H01J 39/12

[58] Field of Search ..... 250/206, 214 R, 239; 317/124; 235/134; 240/DIG. 6; 315/159

[56] References Cited

UNITED STATES PATENTS

| | | | |
|---|---|---|---|
| 3,085,179 | 4/1963 | Keeran | 250/239 X |
| 3,231,747 | 1/1966 | Takeda et al. | 250/215 |
| 3,290,507 | 12/1966 | Flieg et al. | 250/215 |
| 3,599,048 | 8/1971 | Olin | 250/239 X |
| 3,789,220 | 1/1974 | Schacht | 250/206 |

*Primary Examiner*—Walter Stolwein
*Attorney, Agent, or Firm*—Lyon & Lyon

[57] ABSTRACT

A luminaire duration control which, in combination with a photocell, electrically activates an associated luminaire in response to the amount of light received by the photocell. A predetermined time after the luminaire is activated, and prior to its normal deactivation by the photocell, the luminaire is deactivated thereby reducing to a predetermined level the burning hours of the luminaire.

18 Claims, 5 Drawing Figures

LOAD
LINE

LUMINAIRE DURATION CONTROL

BACKGROUND OF THE INVENTION

This invention relates to luminaire duration controls the photoelectric cell actuated devices such as street lights, outdoor advertising, highway signs, etc.

More particularly, this invention relates to a duration control which is compatible with existing photoelectric cell actuated luminaires and the like.

Many luminaires and other type of street lights are controlled by photoelectric cells which dictate the operating or burning hours of the luminaires. More specifically, when dusk approached, the reduced daylight caused the photoelectric cell to close its associated electrical relay and complete a circuit. When the circuit was completed, a power source activated the associated luminaire or luminaires, all in a manner well known in the art. When sufficient light at dawn was received by the photoelectric cell, its associated electrical relay opened, thereby preventing the source from activating the luminaire or luminaires.

Presently used photoelectric cell actuated relay systems result in their associated luminaires being activated for a frequently longer period of time than necessary after daylight. This, of course, when multiplied by the vast number of luminaires, highway signs, etc., controlled by such photoelectric cell actuating devices, amounts to a vast waste of energy. Thus, there is a need for a luminaire duration control device or system which is compatible with existing photoelectric cell actuating systems and has the additional feature of terminating the activation of the associated luminaire, a predetermined time prior to the normal shut-off by the photocell. This duration control system must operate in a simple straightforward, reliable manner without requiring constant maintenance or adjustment and without requiring a comparative amount of energy to accomplish the same.

SUMMARY OF THE INVENTION

It is an object of this invention to provide an energy saving luminaire duration control which is compatible with existing photoelectric cell actuating devices.

It is also an object of this invention to provide an adjustable luminaire duration control for deactivating an associated luminaire, a predetermined time after the luminaire is activated.

It is another object of this invention to provide a rugged, relatively inexpensive luminaire duration control system which will operate satisfactorily in a wide range of outdoor temperature changes.

It is a further object of this invention to provide a luminaire duration control which is adjustable over a several hour time range.

Briefly stated, and according to an aspect of this invention, a duration control mechanism is provided, which in association with a photoelectric cell actuating device controls the burning hours of an associated luminaire.

BRIEF DESCRIPTION OF THE DRAWINGS

The invention both as to its organization and principles of operation, together with further objects and advantages thereof, may better be understood by referring to the following detailed description of an embodiment of the invention taken in conjunction with the accompanying drawings in which.

DETAILED DESCRIPTION

Figures 1, 2, 3, 4, 5:
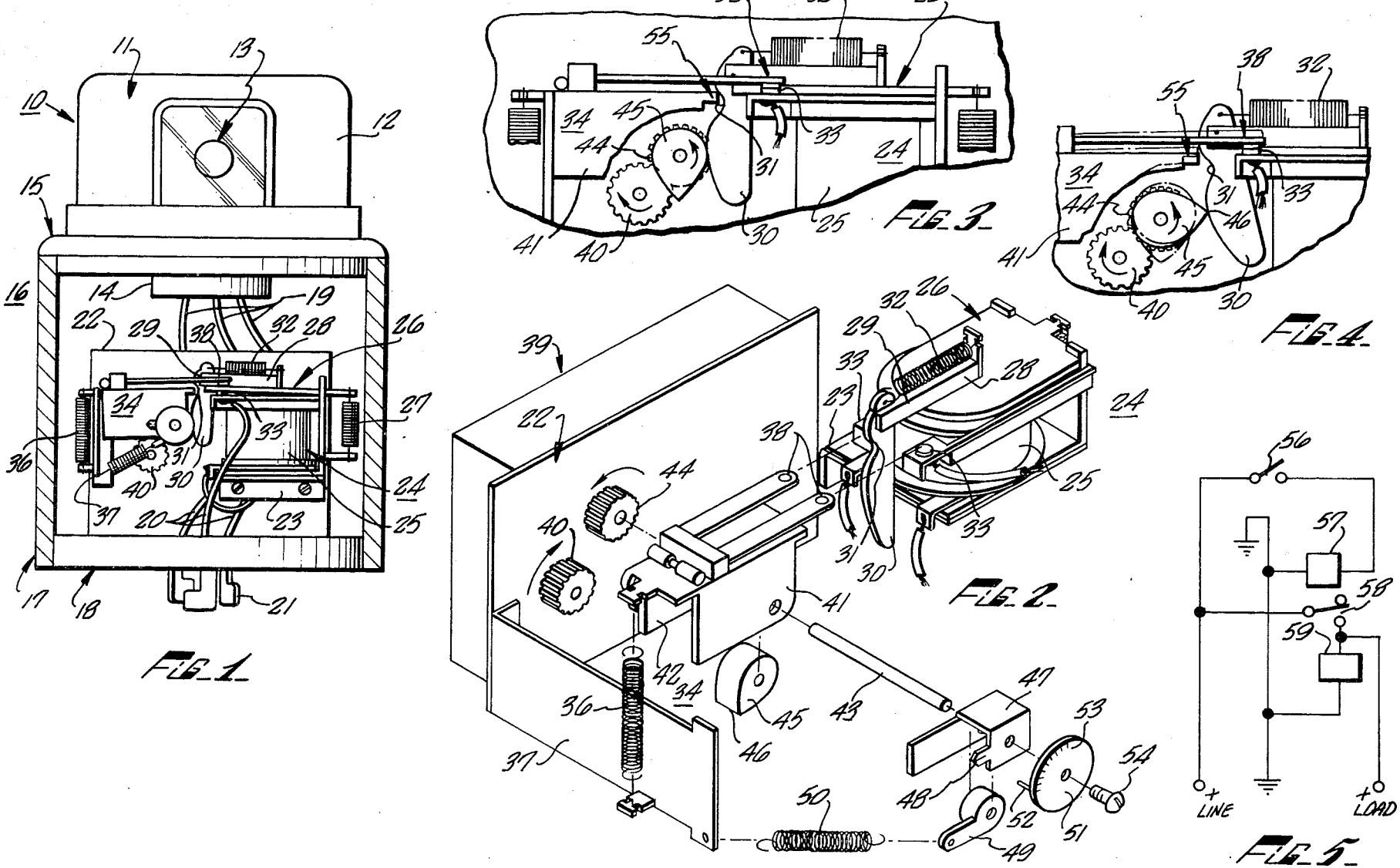
FIG. 1 is a side view, partially in cross section, illustrating an embodiment of the luminaire duration control device in combination with a photoelectric cell actuating device.
FIG. 2 is an exploded perspective view of the luminaire duration control device.
FIG. 3 is a side view of components of the luminaire duration control device when an associated luminaire is activated.
FIG. 4 is a side view of components of a luminaire duration control device a predetermined time after the activation of an associated luminaire.
FIG. 5 is a block circuit diagram illustrating the wiring of the luminaire duration control device.

The present invention is directed to the duration control of luminaire devices or systems which are individually activated and deactivated by a photoelectrical cell at the site, or activated and deactivated with a plurality of other luminaires from a single photoelectrical cell at a central office, all in response to an amount of radiation, such as light, impinging upon photosensitive means at the photoelectric cell or cells. The type of luminaire being controlled is unimportant, and this invention is directed to all types of luminaires, the duration of operation of which is relatively fixed.

Referring now to FIG. 1, there is illustrated a luminaire duration control device of the present invention in combination with conventional photoelectric cell actuating device indicated generally by the numeral 10 and comprising a housing 11 and a translucent lens member 12 included therein. The lens 12 permits radiation, such as light, to impinge upon a photosensitive member such as photocell 13, positioned behind the lens 12 in the housing 11. Also included in the housing 11 of the actuating device 10 is a relay (not shown). When the photoelectric cell 13 receives reduced daylight such as at dusk, the relay closes and the associated luminaire is activated.

The housing 11 of the actuating device 10 is typically cylindrical in shape, 3 inches in diameter and 2¼ inches in height. The actuating device 10, as is well known in the art, contains a male three pole or prong twist lock plug (not shown). In the past, the male plug was connected directly to a female three pole or prong twist lock electrical receptacle on the top of the photoelectric cell controlled luminaire or the like. In accordance with the present invention however, the male plug of the actuating device 10 is connected to such a female receptacle 14 mounted in a top portion 15 of the luminaire duration control unit or device 16. The top portion 15 is mounted on a housing 17 of the unit 16 in any manner to provide ease of assembly. The housing 17 of the unit 16 is cylindrical in shape to be aesthetically acceptable and preferably color coordinated with the device 10. The unit 16 may be formed of a variety of materials such as a plastic or metal. A bottom portion 18 is mounted to the housing 17 by means well known in the art to provide both entry into the interior of the unit 16 and ease of assembly.

Portions of the female receptacle 14 are electrically connected to first line, load and ground wires 19 which in turn are electrically connected to the lumination control mechanism in the unit 16 in a manner explained in further detail when referring to FIG. 5. From the luminaire duration control mechanism, second line, loaded and ground wires 20 are electrically connected through the bottom portion 18 of the housing 16 to a male three pole or prong twist lock plug 21. The plug 21 is the same type of plug typically incorporated in the bottom of standard photoelectric cell actuating devices and, as such, may readily engage the female receptacle installed with a standard photoelectric cell controlled luminaire or other photocell controlled devices.

The luminaire duration control mechanism illustrated in housing 17 of unit 16 is in its relaxed or full de-energized position. This condition or state will occur when there is sufficient radiation, e.g. light, impinging upon the photocell 13 to open its associated relay. In this state, the luminaire is not activated and the luminaire duration control mechanism uses no energy.

Depicted in the housing 17 is a frame member 22 which may be connected to the unit 16 in any convenient manner. The frame member 22 may be formed of a variety of materials such as a plastic or metal. Mechanically connected to the frame member 22, through a bracket 23, is an electromagnetic assembly, generally designated by the numeral 24. The assembly 24 basically comprises an electromagnet 25 electrically connected through the wires 19 to the device 10. When the electromagnet 25, which has a rating such as 120 volt, 2½ amp, is energized, (such as at dawn), it attracts or activates its associated hinged loaded armature plate 26. The armature plate 26 is loaded by means of a spring 27.

Mounted on the armature plate 26 is an armature bar 28 which extends over the electromagnet 25 at an end 29. A loaded lever 30 having a notched portion 31 is hinged to the bar 28 at the end 29. The lever 30 is loaded by means such as spring 32 mounted with respect to the bar 28. Also associated with the electromagnetic assembly 24 are the stationary contacts 33 of a single pole 15 amp electrical relay.

A loaded carriage assembly, generally designated by the numeral 34, is hinged to a side frame member 37 which in turn is connected to the frame member 22. The carriage assembly 34 is loaded by means of a spring 36 connected at a convenient location such as to the side frame member 37. Mounted on the top of the assembly 34 are movable contacts 38 for the single pole 15 amp electric relay.

Referring now to FIG. 2, a motor assembly or drive means 39 is mounted on the back side of the frame member 22. The motor assembly 39 includes a conventional motor such as a 120 volt 2 amp electric motor, and includes a gear train (not shown) which ultimately produces, at an end gear 40, at the front side of the frame member 22, a predetermined speed, such as of one revolution per twenty four hours. The end gear 40 is illustrated as being driven in a clockwise direction by the motor assembly 39.

The electromagnetic assembly 24 is mounted on the bracket 23 and mechanically coupled to the frame 22 in the manner described when referring to FIG. 1. Likewise, the components of the assembly 24 are numbered in the manner of FIG. 1. When the electromagnet 25 is not activated or energized, the armature plate 26 and the bar 28 will not be attracted thereto. When the relay associated with the photocell 13 is closed, the current from the power source will activate the electromagnet 25 thereby causing the armature plate 26 to be attracted thereto.

Mounted at the end 29 of the armature bar 28 is the hinged spring loaded notched lever 30 having a notch portion 31. The notch lever 30 may be integrally formed with its loading member, such as in the case of a clock spring or the like. A first requirement of the lever is that it include a notch or the like, capable of physically urging and maintaining the carriage assembly 34 in a downward position (as shown in FIG. 3), when the electromagnet first attracts its armature. A second requirement is that the lever release the carriage assembly after a predetermined time (as shown in FIG. 4).

Components of the carriage assembly 34 such as the movable contacts 38, are numbered as in FIG. 1. The assembly 34 is hinged to the side frame member 37 in the manner previously indicated. Disposed through a front wall 41 and a rear wall 42 of carriage assembly 34 is a shaft 43. A mating gear 44 is mounted on a first or rear end of the shaft 43 between the front of the frame member 22 and the rear wall 41 of the carriage assembly 34. The mating gear 44 is adapted to mesh with gear 40 and be driven thereby in a counter clockwise direction when the carriage assembly 34 is in its first position, i.e. is forced in a downward position by the notch portion 31 of the spring loaded lever 30. When the carriage assembly 34 is in its first downward position, there is provided electrical contact between the movable contacts 38 and the stationary contacts 33 for activating both the associated luminaire and the motor assembly 39.

Disposed between the front wall 41 and the rear wall 42 of the carriage assembly 34 is a cam 45, having a cam face portion 46, mounted on the shaft 43, in a manner which will drive the cam 45 counter clockwise when the shaft 43 is correspondingly driven. Appropriate spacers (not shown) may be utilized anywhere along the shaft 43, if necessary.

On the second or front end of the shaft 43, there is mounted a bracket 47 including an indexing marker tab 48 which allows relative distances, for time adjustment purposes, to be measured. The bracket 47 is coupled to any convenient member, such as the front wall 41 of the carriage assembly 34. Internal to the bracket 47 and mounted on the shaft 43 is a cam return 49 which is loaded by means of spring 50, which in turn is connected to a portion of the side frame member 37. Concentrically disposed about the second end of the shaft 43 and outside of the bracket 47 is an adjustable cam stop 51 including a stop detent 52. The cam stop 51 includes incremental markers, such as marker 53, which depending upon their relative distance from the indexing tab 48, will indicate a set or start position for the shaft 43. When the spring 50 causes the cam return 49 to abut the detent 52, the start position is determined. The cam return 49 is aligned with the cam face 46 to provide a proper start position. The adjustable cam stop member 51 is held stationary with respect to the shaft 43 by a screw 54.

FIG. 3 illustrates the end gear 40 and the mating gear 44 in a meshed position. In this state, the electromagnet 25 is energized or activated which causes associated spring loaded armature plate 26 to be pulled toward the electromagnet 25. When this occurs the hinged lever 30 is likewise forced in a downward direction and the notch portion 31 engages a front lip portion 55 of the carriage assembly 34 thereby forcing the carriage assembly 34 in a downward or engaged first position. This realizes an electrical connection between the movable contacts 38 of the carriage assembly 34 and the stationary contacts 33 of the electromagnet assembly 24.

When this electrical contact is made, both the motor and associated luminaire are activated. Further, when the carriage assembly is forced in the downward direction the mating gear 44, which also moves in a downward direction with the moving of the carriage assembly 34, engages the end gear 40 and is driven in the direction indicated in FIG. 3.

FIG. 4 illustrates the cam 45 in a first position, as indicated by the phantom lines, and a second position. When the shaft 43 and its associated cam 45 is driven by the end gear 40 a predetermined distance as determined by the initial setting of the adjustable cam stop 51, the cam face portion 46 of the cam 45 abuts a lower portion of the hinged lever 30 and forces the lever 30 rearwardly and eventually the notch 31 thereof to become disengaged from the lip 55 of the carriage assembly 34. Once the carriage assembly 34 is released by the notch 31, the carriage assembly pivots counter clockwise under the influence of spring 36 and the movable contacts 38 are electrically disconnected from the stationary contacts 33 thereby deactivating the motor and luminaire. The gears 44 and 40 also disengage allowing the shaft 43 and cam 45 thereon to return to its first or original position as a result of the force of spring 50. It is noted that the armature of the electromagnet is still in a contact state due to the fact that the electrical relay associated with the photocell is still in a closed state. When the photocell receives enough light to cause its associated relay to open, the armature will return to its opened or relaxed state.

Referring now to FIG. 5, there is a wiring diagram which shows a relay 56 which is associated with the photocell 13 of FIG. 1. When relay 56 is in a closed state, such as when the photocell 13 receives insufficient light at dawn, the power source from the line activates an electromagnet 57. Once the electromagnet 57 is activated, relay 58 completes a circuit thereby activating a motor 59. The relay 58 is, of course, a representation of the movable contacts 38 and stationary contacts 33.

In operation, reduced daylight at dusk causes the photoelectric cell 13 to close its associated electrical relay 56. The electrical input from the photoelectric cell 13 energizes the electromagnet 25 thereby causing movement of the electromagnet armature plate 26. This causes the notched lever 30 to move the carriage assembly 34 in a downward direction. Movement of the carriage assembly 34 in the downward direction causes its associated gear 44 to engage the end gear 40 and also causes the closing of the relay 56. When the relay 56 is in a closed state (i.e. the movable and stationary contacts are electrically connected), the motor is activated, the gears 44 and 40 are meshed and the luminaire is activated. The motor assembly 39 and its associated gear train drives the cam 45 during its operating period as set by the start position of the cam stop 51.

At the end of the operating period, the cam face 46 drives the lever 30 mounted on the end 29 of the armature bar 28 to release the carriage assembly 34 from its engaged position into a relaxed or second position. The released carriage goes back to its normal upward second position and correspondingly opens the relay 58 thus de-energizing the motor and the luminaire.

The spring 50 of the cam return 49 now causes the shaft 43 to be rotated in a clockwise direction (since the gear 44 is no longer meshed with gear 40) and be reset to a start position as determined by the cam stop 51.

Thus, the device is reset for the next night's operation. During daylight hours all components in the duration control device are de-energized so that no power is consumed during that period.

The time interval of operation of the luminaire is controlled by loosening the screw 54 and the cam stop 51 and then moving the cam stop 51 to the location producing the cam travel required by the cam face 46 of the cam 45 to provide the desired operating interval for the luminaire. Marker 53 and indexing tab 48 may readily be calibrated to achieve a desired degree of accuracy.

A peripheral benefit to be derived from the use of this luminaire duration control deivce is that its larger capacity relays permit it to control a much greater load than the photocell alone. Further, photoelectric cell reliability improves with the reduction of loading from up to 1,000 watts to about 2½ watts.

While an embodiment and application of this invention has been shown and described, it will be apparent to those skilled in the art that many more modifications are possible without departing from the inventive concepts herein described. The invention, therefore, is not to be restricted except as is necessary by the prior art and by the spirit of the appended claims.

I claim:

1. A luminaire duration control device comprising:

means for providing a predetermined time delay;

driving means for initiating said means for initiating a predetermined time delay;

a carriage member for electrically activating a luminaire and for electrically and mechanically activating said driving means in a first position, and for electrically deactivating the luminaire and electrically deactivating and mechanically decoupling said driving means in a second position;

first means for positioning said carriage member in its first position in response to a predetermined event; and second means for positioning said carriage member in its second position after the predetermined time delay.

2. The control device as in claim 1 wherein said carriage member includes a first gear member, and said driving means includes a second gear member, said first gear member being mechanically coupled to said second gear member when said carriage member is in its first position.

3. The control device as in claim 2 further including stationary contacts, and said carriage member further including movable contacts mounted thereon, said movable contacts being electrically connected to said stationary contacts thereby activating the luminaire and driving means when said carriage member is in its first position.

4. The control device as in claim 3 wherein said first means includes an electromagnetic member having a loaded armature and a loaded lever having a notched portion coupled to said armature, said electronagmetic member being activated in response to the predetermined event thereby attracting said armature toward said electromagnetic member and causing the notched portion of said loaded lever to mechanically position said carriage member in its first position.

5. The control device as in claim 4 wherein said means for recording the predetermined time delay includes a shaft member coupled to said first gear member and a cam mounted on said shaft member, a cam face of said cam urging said lever in a manner which results in said lever mechanically releasing said carriage member from its first position.

6. The control device as in claim 5 wherein said shaft member includes an adjustable cam stop mounted thereon, said cam stop controlling the distance said cam face travels.

7. The control device as in claim 6 wherein said shaft member includes a loaded cam return which urges said cam face to a set position when said carriage member is in its second position.

8. A luminaire duration control device for a luminaire having a photoelectric actuating device comprising:

a housing mechanically connected to the photoelectric actuating device and providing an electrical connection therefor at a first portion, and providing an electrical connection to the luminaire at a second portion;

duration control means mounted in said housing and including a carriage member which, in a first position electrically activates the luminaire and initiates a delay mechanism coupled therewith, all in response to a predetermined amount of radiation received by the photocell, and after a predetermined delay provided by said delay mechanism, in a second position electrically deactivates the luminaire and said delay mechanism; and first means disposed in said housing, and electrically coupled to the actuating device for positioning said carriage member in the first position in response to a predetermined amount of radiation received by the photocell.

9. The control device as in claim 8 wherein said control means includes a driving means for driving said delay mechanism.

10. The control device as in claim 9 wherein said carriage member mechanically activates said driving means in the first position and mechanically decouples said driving means in a second position after the predetermined delay.

11. The control device as in claim 10 wherein said carriage member is a hinged loaded carriage member which positions said assembly in its second position after the predetermined delay.

12. The control device as in claim 11 wherein said carriage member includes a first gear member, and said driving means includes a second gear member, said first gear member being mechanically coupled to said second gear member when said carriage member is in its first position.

13. The control device as in claim 12 further including stationary contacts, and said carriage member further including movable contacts mounted thereon, said movable contacts being electrically connected to said stationary contacts thereby activating the luminaire and driving means when said carriage member is in its first position.

14. The control device as in claim 13 wherein said first means includes an electromagnetic member having a loaded armature and a loaded lever having a notched portion coupled to said armature, said electromagnetic member being activated in response to the predetermined event thereby attracting said armature toward said electromagnetic member and causing the notched portion of said loaded lever to mechanically position said carriage member in its first position.

15. The control device as in claim 14 wherein said delay means includes a shaft member coupled to said first gear member and a cam mounted on said shaft member, a cam face of said cam urging said lever in a manner which results in said lever mechanically releasing said carriage member from its first position.

16. The control device as in claim 15 wherein said shaft member includes an adjustable cam stop mounted thereon, said cam stop controlling the distance said cam face travels.

17. The control device as in claim 16 wherein said shaft member includes a loaded cam return which urges said cam face to a set position when said carriage member is in its second position.

18. A luminaire control device comprising:

a photoelectric activating device drive means;

movable carriage having a first position in which said drive means and luminaire are connected to a power source for activation thereof and a second position in which said drive means and said luminaire are disconnected from the power source for deactivation thereof;

first positioning means activated by the photoelectric activating device for positioning said movable means in said first position; and second positioning means driven by said drive means affecting said second position of said movable means after a predetermined time period.

* * * * *